United States Patent [19]

Kicherer et al.

[11] Patent Number: 4,922,080

[45] Date of Patent: May 1, 1990

[54] COOKER PLATE

[75] Inventors: Robert Kicherer; Felix Schreder, both of Oberderdingen, Fed. Rep. of Germany

[73] Assignee: E.G.O. Elektro-Gerate Blanc u. Fischer, Fed. Rep. of Germany

[21] Appl. No.: 236,769

[22] Filed: Aug. 25, 1988

[30] Foreign Application Priority Data

Aug. 27, 1987 [DE] Fed. Rep. of Germany ..... 3728535

[51] Int. Cl.[5] ..... H05B 3/70

[52] U.S. Cl. ..... 219/457; 219/451

[58] Field of Search ..... 219/448, 449, 451, 457, 219/458, 459, 460, 461, 463, 464, 467

[56] References Cited

U.S. PATENT DOCUMENTS

| | | | |
|---|---|---|---|
| 4,410,793 | 10/1983 | Fischer | 219/460 |
| 4,650,969 | 3/1987 | Kicherer et al. | 219/451 |
| 4,767,915 | 8/1988 | Hurley | 219/467 |
| 4,818,846 | 4/1989 | Kicherer et al. | 219/458 |

FOREIGN PATENT DOCUMENTS

| | | | |
|---|---|---|---|
| 113923 | 8/1985 | European Pat. Off. . | |
| 0224098 | 6/1987 | European Pat. Off. . | |
| 692301 | 10/1937 | Fed. Rep. of Germany . | |
| 8511580 | 2/1985 | Fed. Rep. of Germany . | |
| 437566 | 11/1967 | Switzerland | 219/443 |
| 624259 | 6/1949 | United Kingdom | 219/449 |

*Primary Examiner*—Teresa J. Walberg

*Attorney, Agent, or Firm*—Steele, Gould & Fried

[57] ABSTRACT

In a cooker plate (1) connection of the particular electric hotplate (3) a window opening (19) is provided as an assembly opening in a holding part (5) substantially completely covering the same on the underside, through which can be passed a connecting piece (21) for the electrically conducting connection to the connecting members (15) of hotplate (3). This window opening (19) can be substantially completely closed with a closure (20), the latter being constructed in one piece with a ceramic insulator (22) of connecting piece (21) or can be formed by a separate component made from sheet metal or the like. This leads to a very reliable and effective closure of the cooker plate (1), also on the underside thereof.

22 Claims, 6 Drawing Sheets

11
8
13
3
15
23
29
27
22
21
24
26
20
25
19
10
17
16
18
2
1
4
9
13
11
14
15
12
7
6
8
5
3

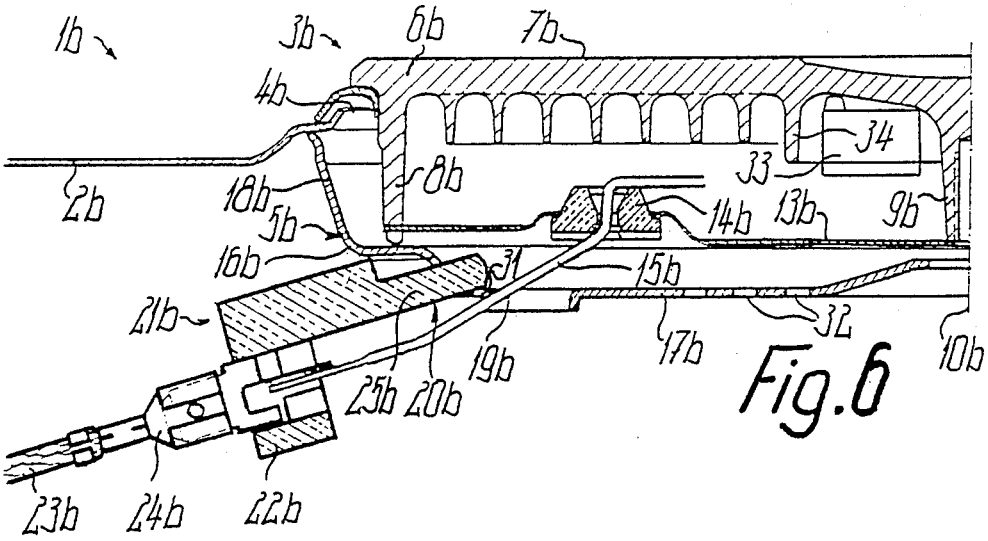
Fig.6
Fig.7
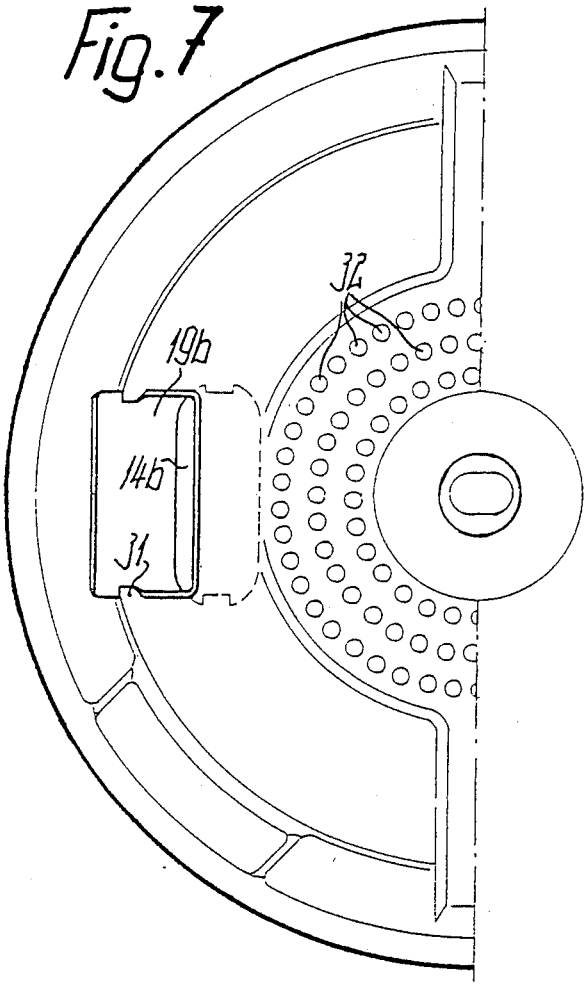

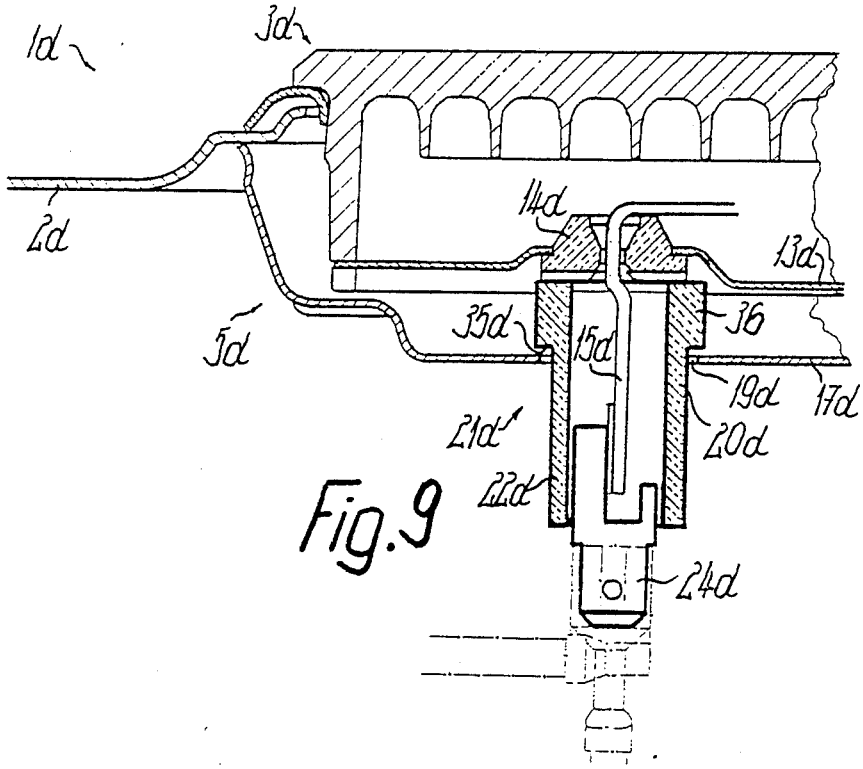
Fig. 9
Fig. 10
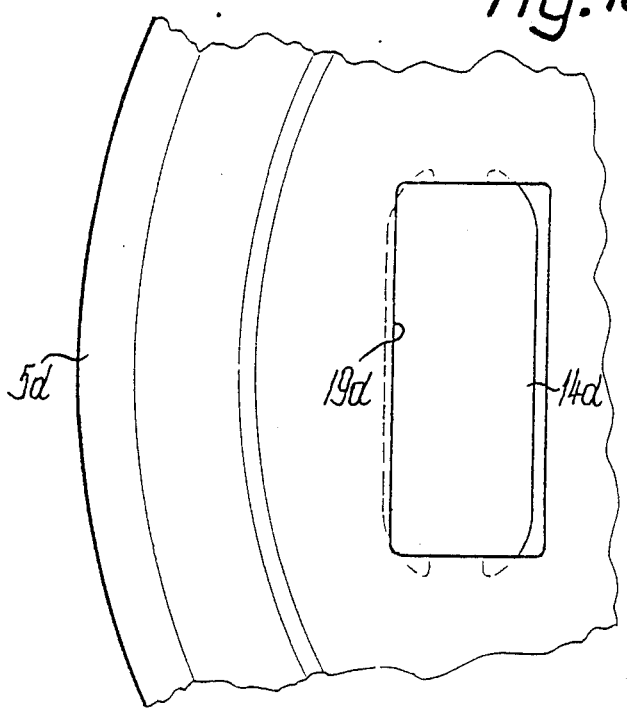

COOKER PLATE

BACKGROUND OF THE INVENTION

1. Field of the Invention

The invention relates to a cooker or hob plate with a built-in or mounting plate for receiving against its top surface at least one electric hotplate in a plate opening, with a holding part to be supported on the underside of the mounting plate at least partly engaging over the underside of the hotplate and with electrical connecting members provided on the underside of the hotplate and in the vicinity of which the holding part has a window opening for the supply of connecting lines to the connecting members.

2. Prior Art

Cooker plates of this general description can e.g. be formed by a table plate in which the mounting plate is inserted, or by the upper casing plate of a cooker casing enclosing a baking oven. The window opening, in order to ensure good accessibility for the connection of the electric hotplate, is generally made relatively large, but then following the connection of the hotplate its associated area having numerous bare electric conductor parts is free, so that on the one hand it can easily become dirty or covered with condensation and on the other hand accidental electric contact with electrically conductive parts is possible.

SUMMARY OF THE INVENTION

An object of the present invention is to provide a cooker plate or a lower cover of an electric hotplate, by which it is possible in simple manner to ensure an at least partial shielding of the connection area of the electric hotplate.

According to the invention this object is achieved in the case of a cooker plate of the aforementioned type, in that a closure is provided for the at least partial closing of the window opening and that the closure has at least one passage for the connections to the connecting members. The appropriately completely detachable or removable closure can virtually tightly close the window opening, so that the lower electric hotplate cover, mostly formed by the holding member, forms a substantially closed casing zone with the cooker plate and even during access to the bottom of the cooker plate through raising the cover plate, there is no risk of an accidental contact with electrically conductive parts as a result of the complete shielding. This is particularly the case if the holding member is cover-like and not, as is also possible, bow-shaped or star-shaped.

The lower cover or holding part can, in the case of a cooker plate having two or more electric hotplates, be separately constructed for each individual hotplate or can be formed by a component common to two, more or all the electric hotplates and which is appropriately provided in the manner of a profiled plate with disk-like, flat depressions for the engagement of the particular hotplate and with reinforcing fins or similar profilings for reinforcement purposes. With a circumferential edge, the holding part appropriately engages in substantially full-surface manner on the underside of the cooker plate, whereby it is braced against tension and a substantially tight connection is obtained.

A particularly advantageous further development of the invention is obtained in that for connecting the connecting lines to the connecting members of the electric hotplate a connecting piece is provided, which is preferably located in the vicinity of the closure and in particular has an insulator. The insulator is appropriately constructed in such a way that the connecting lines are at least provided up to its associated outer face and in particular projecting into the same with an insulating jacket, so that even if the insulator projects outwards over the cover or closure, no bare electrically conducting parts are exposed. The closure or its insulator can be located completely on the inside of the closure or completely on the outside thereof and can project both over the inside and the outside of the closure.

In a particularly easily realisable embodiment, at least in the closure position, the closure is provided on the connecting piece, so that through connection to the latter it can be precisely oriented or held on the connecting piece and the latter, if it is also fixed to the holding part, is precisely aligned or oriented with respect to the window opening.

If the closure is formed by a separate, e.g. sheet metal bent component, then it appropriately has a passage opening for the connecting lines or for the connecting piece for its insulator, said passage opening being appropriately closely adapted to the outer contour of the insulator.

It is also advantageously possible for the connecting piece or its insulator to directly form the closure. Thus, the closure can be made from a ceramic material, e.g. steatite, or from the same material as the insulator.

In the case of certain hotplates, particularly those with a high rated or residual capacity, or those which are provided with a thermal cutout and are therefore protected, undesirably high temperatures can result from an excessively tight or shielded termination of the underside. This can be counteracted, while retaining the aforementioned advantages, by the provision of at least one ventilating opening, which can at least partly be formed, or whereof at least one can be formed by a portion of the window opening, so that the optionally circulating air can be passed along or through the connecting piece or its insulator. Advantageously the window opening is closed in its area further removed from the central axis of the hotplate or nearer the circumference of the holding part, while the radially further inwardly located part is open in the described manner. However, in this case the connecting area of the hotplate or connecting members can be at least partly exposed on the underside of the holding part.

The electrical connection of the electric hotplate can take place in a particularly simple manner if the connecting piece is constructed for a plug connection with the connecting members and/or connecting lines. The closure connected to or formed by the connecting piece can in the case of such a construction particularly be exclusively held in its closed position by the connection of the connecting piece to the connecting members.

Instead of this or in addition thereto, the closure can also be detachably fixed to the holding part by means of a suitable connection, especially a plug connection. The plugging direction of this plug connection is appropriately approximately parallel to the plugging direction of the connecting piece for connecting to the connecting members of the electric hotplate, so that both connections can be simultaneously formed by a single plugging process.

If the closure is positively connected in the closed position both to the connecting piece and to the holding part so as to prevent movements in the pulling direction of the connecting lines, in simple manner the closure can form a tension relief means for the connecting lines or piece and there is no need for a separate tension relief means.

A very simple connection of the closure to the holding part is e.g. obtained in that the closure cooperates with the marginal zones of the window opening and can e.g. engage over said marginal zones, at least on the inside or outside of the holding part in flap-like manner, so that it is supported against displacement movements on at least on boundary edge of the window opening. For this purpose the closure and also the marginal zones can be provided with receiving or engaging-round grooves. If at least one groove is provided on at least one lateral face and in particular on both lateral faces of the closure or the insulator, in simple manner a sliding guide is obtained for inserting the closure in the closed position or the connecting piece in the connected position.

If in the described manner the connecting piece is guided with respect to the holding part and therefore with respect to the electric hotplate, then in the case of electrical connection to the connecting members it is precisely oriented with respect thereto, so that the connecting members on inserting the connecting piece automatically slide into the associated plugging openings of the connecting piece.

The mounting support for the closure and/or the connecting piece formed by the holding part or the window opening boundary can be constructed in such a way that there is a precisely defined positioning of the connecting piece or the closure. For example, the connecting piece can be held so as to slope outwards under an angle between approximately 15° and 30° and apart from being supported by an upper end on the holding part, it can also be supported on a lower cover plate of the hotplate. This also permits the hotplate to have a relatively high residual power.

In order to be able to place the connection of the connecting members to the connecting piece or the connecting lines a relatively long way away from the hotplate and thereby bring about protection against overheating, it is also possible to arrange the connecting piece so as to be positioned approximately vertically downwardly directed, so that it essentially projects over the underside of the holding part and it or its insulator can be inserted from the inside of the holding part in the window opening in such a way that a widened head engages on the inside of the holding part. The connecting members are appropriately passed through an insulating sleeve arranged on the bottom of the hotplate or on the cover plate and on which the connecting piece or its insulator can be supported in such a way that it essentially forms an extension of said insulating sleeve. Simultaneously the insulator can define air ducts, which lead into the space between the hotplate and the holding part and/or into the space between the hotplate body and its lower cover plate.

In order that in the case of correspondingly high capacity and particularly when using a thermal cutout arranged on the underside of the hotplate body, overheating due to a heat build-up is avoided, appropriately the central zone of the particular cooking point is provided on the bottom with an additional ventilating means, which can e.g. be formed by at least one ventilating opening in the holding part located radially inside the window opening. It is possible to provide holes distributed in grid-like manner or at least one larger stamping-out segment.

In particular in the case of the described cooker or cooking plate, but also in the case of differently constructed plates, the invention also proposes that the insulator of the connecting piece has at least one connecting organ for connecting to a complementary insulator, so that e.g. an insulator constructed for a one or two-pin connecting piece can be connected to at least one further insulator to form a closed constructional unit in such a way that a two, three or four-pin connecting piece is formed. Thus, when using the same insulator, it is possible to obtain connecting pieces for two or multiple-pin hotplates. It is also conceivable to connect the insulators to one another at an angle, radially or in some other way, but preferably a series connection is provided, so that the connecting pins are juxtaposed in series with the insulators assembled. The connecting organs can be formed by separate parts, e.g. hollow rivets, clips, etc., but are appropriately constructed in one piece with the insulator from an insulating material, so that it is possible to completely do without metallic parts.

These and other features of preferred further developments of the invention can be gathered from the claims, the description and the drawings and individual features can be realized either alone or in the form of subcombinations in an embodiment of the invention and in other fields and constitute advantageous constructions for which patent protection is independently claimed. Embodiments of the invention are described in greater detail hereinafter relative to the drawings, wherein are shown:

BRIEF DESCRIPTION OF DRAWINGS

FIG. 6, a detail of another cooker plate in cross-section.

FIG. 7, the detail according to FIG. 6 in a view from below, on a smaller scale and without a connecting piece.

FIG. 9, another embodiment in a representation corresponding to FIG. 6.

FIG. 10, the embodiment according to FIG. 9 in a detail view from below and without a connecting piece.

DETAILED DESCRIPTION OF THE PREFERRED EMBODIMENTS

Figures 1, 2:
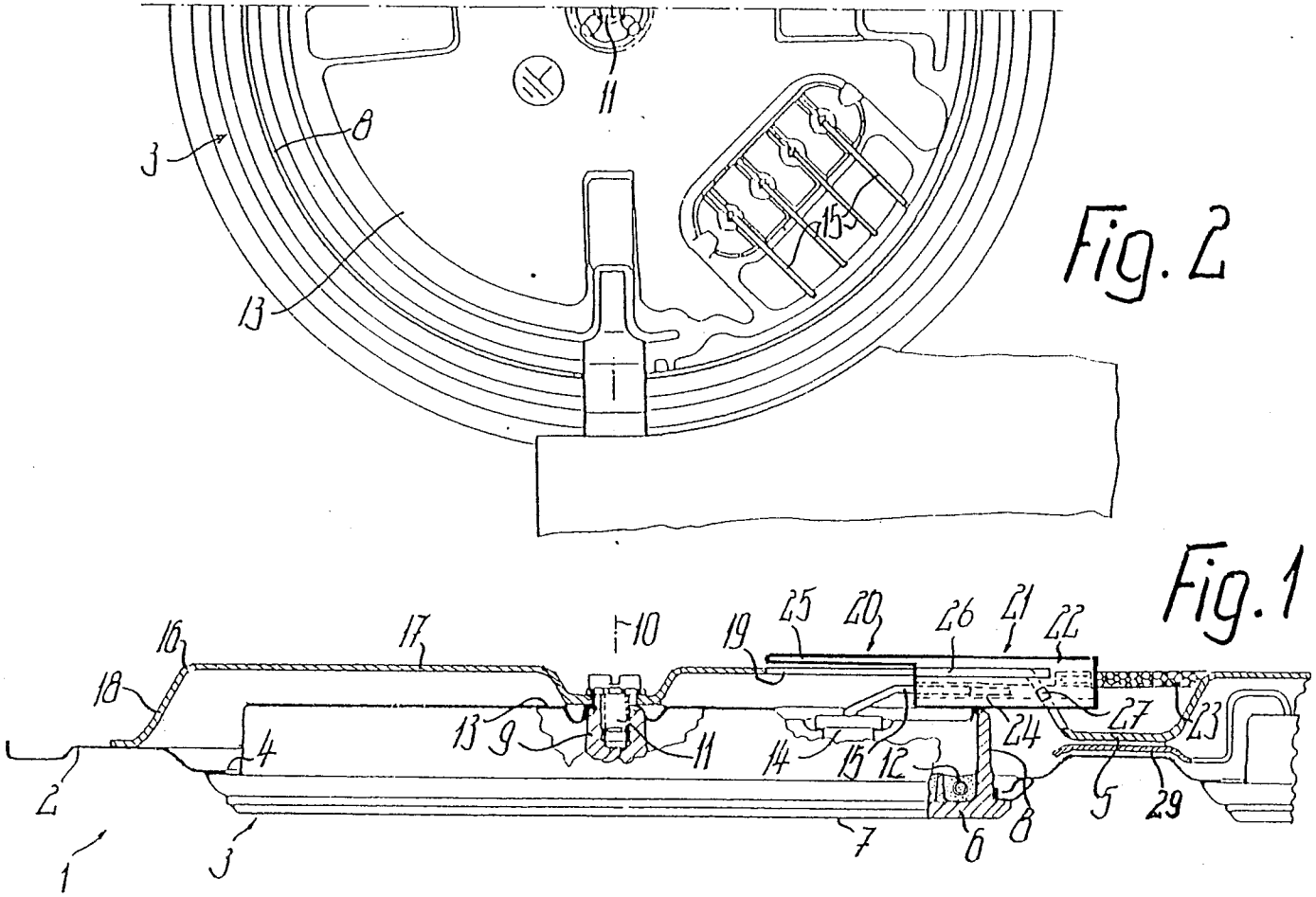
FIG. 1, a detail of an inventive cooker plate in cross-section in the mounting or upside down position.
FIG. 2, a detail of the electric hotplate according to FIG. 1 in a view of the underside.

As shown in FIG. 1, an inventive cooker plate 1 showed in the upside down or mounting position has a built-in or mounting plate 2 profiled from thin, stainless steel sheeting and which receives in a plate opening 4, one or two or more juxtaposed or successive electric hotplates 3, which are provided in a raised portion of the mounting plate 2, compared with the adjacent zones. Electric hotplate 3 is placed under tension on the top of the protuberance and for this purpose on the underside of mounting plate 2 is provided a flat holding part 5 shaped from thicker sheet metal and which is only slightly smaller than the base surface of mounting plate 2.

Although optionally also other hotplates or hot point heating means can be provided, the inventive construction is preferably provided for those electric hotplates 3, which have on the top surface substantially closed hotplates bodies 6 made from cast material having a circular, planar cooking surface 7 surrounding a central depression, whilst an outer flange edge 8 projects downwards on the underside of the hotplate body 6 with limited radial spacing from its widest outer circumference located at cooking surface 7. In the central axis 10 of the round, e.g. circular or annular, e.g. rectangular or square hotplate body 6, a central stud 9 tapered downwards projects over its underside by roughly the same extent as the flange edge 8. For receiving a fastening bolt 11, the central stud 9 has a blind hole-threaded bore made from its lower end. Connected to the inner circumference of the flange edge 8 at least one spiral groove is provided in a ring zone having roughly the same size as the cooking surface 7 on the underside of the hotplate bodies 6 and in each spiral groove at least one heating resistor 12 formed by a wire coil is embedded in a compressed insulating material. The ring zone can be bounded on the inner circumference by a wider flange edge projecting less far downwards than the flange edge 8 and which spacedly surrounds the central stud 9.

The underside of the electric hotplate 3 or the hotplate body 6 is closed by a, substantially planar cover plate 13 of sheet metal or the like, which extends to the outer flange edge 8 or to its lower end face and is fixed against the lower end face of the central stud 9 using the fastening bolt 11 and is consequently secured against the hotplate body 6. To the outer circumference of flange edge 8 is fixed a profile ring supported on a ring shoulder adjacent to the cooking surface 7 and which is used for securing the electric hotplate 3 against the top of the protuberance of the mounting plate 2 outside the boundary of plate opening 4.

The cover plate 13 is traversed between the two flange rings by an insulating sleeve 14 made from a ceramic material, such as steatite and which is flat oval in elevation, which is carried by the cover plate 13 and traversed by connecting wires, which are electrically conductively connected with downwardly projecting terminal pins of the heating resistor 12 on the inside of the cover plate 13. The connecting wires pass through the insulating sleeve in juxtaposed manner and on the underside thereof are bent away parallel to one another at the same height from the central axis 10, in such a way that they form outwardly projecting, pin-like connecting members parallel to the cooking surface 7, which are resiliently inherently rigid for their positional stability and which serve for the electrical connection of the electric hotplate 3.

The holding part 5 is supported adjacent to the particular protuberance on the underside of mounting plate 2 and in the vicinity of each electric hotplate 3 forms a flat cover pan 16 roughly coaxial to its central axis 10 and whose bottom walls 17 is substantially parallel to and a slight distance below the underside of the hotplate 3. Bottom 17 passes via an upwardly, acute-angled, conically widened jacket 18 into those outwardly bent areas with which the holding part is supported on the underside of mounting plate 2. Bottom 17 can also be fixed to the lower end face of the central stud 9, e.g. by an upwardly projecting stamped-out portion. The cover pan 16 is in this state so elastically pretensioned, that it engages with adequate pressure on the underside of the mounting plate 2.

Figure 4:
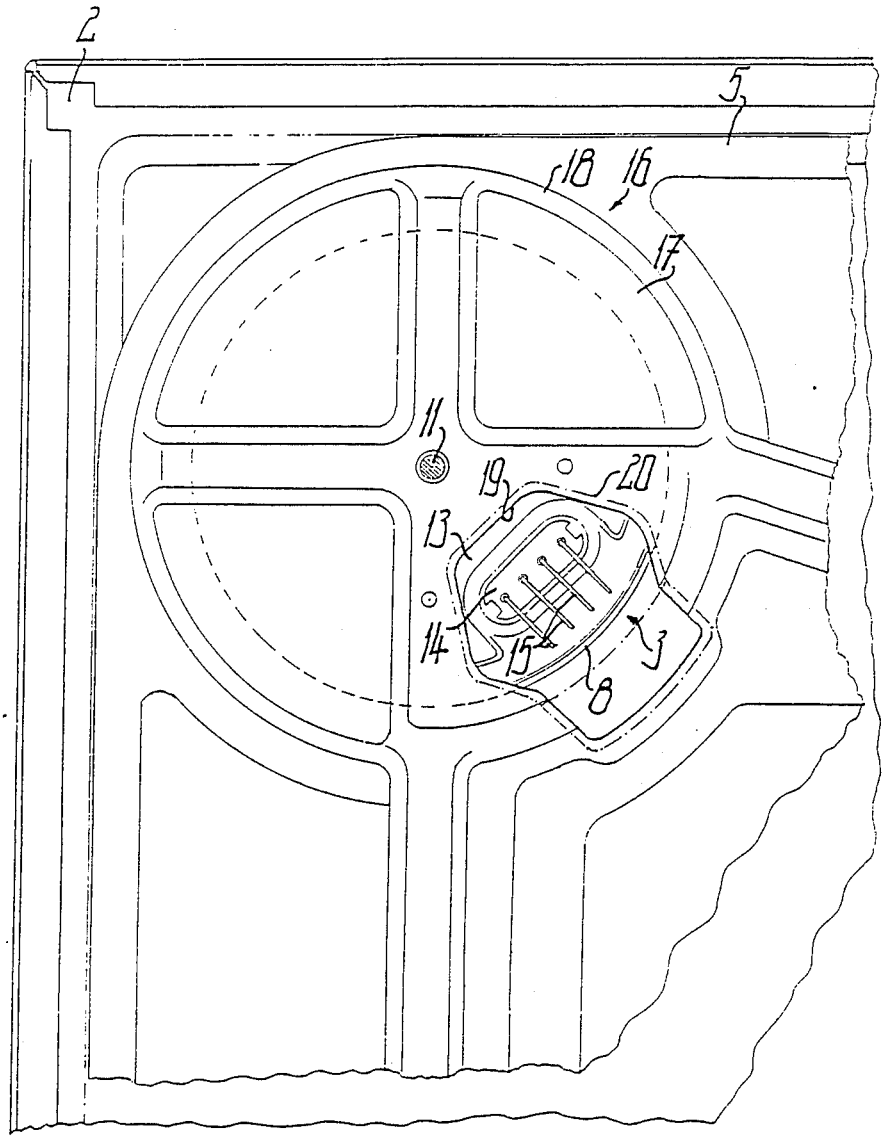
FIG. 4, the cooker plate according to FIG. 1 in a view of the underside.

In the vicinity of the connecting members 15, a window opening 19 is provided as an access opening in the cover pan 16 and which in the view according to FIG. 4 is much larger than the base surface of the insulating sleeve 14, including the field taken up by the connecting members 15. Window opening 19 extends both over the bottom 17 and over the jacket 18 of the cover pan 16 and can even extend into the area connected thereto by which the cover pan 16 or the holding part 5 is fixed against the underside of the mounting plate 2 adjacent to the electric hotplate 3. In elevation, the window opening 19 can be bounded in a substantially rectangular manner or, according to FIG. 5, can be widened by an approximately double trapeziodal boundary in the vicinity of the connecting members 15. For closing the window opening 19 is provided an e.g. at least partly plate-like closure 20, with which the window opening 19 can be substantially completely closed. The connecting members 15, which appropriately do not project over the outer circumference of the hotplate 3 or the hotplate body 6 or the flange edge 8, are located completely within the cover pan 16.

For the electrical connection of electric hotplate 3 is provided a connecting piece 21, which is connected to connecting lines 23, which lead to a manually operable switch for the power setting of the hotplate. The connecting piece 21 constructed as a flat body parallel to the underside of hotplate 3 has an insulator 22 made from ceramic material, e.g. steatite, in which are provided juxtaposed, separate leads, which are formed on one connecting side of the connecting piece 21 for connection to the connecting lines 23 and on the other connection side for connecting to the connecting members 15 of hotplate 3. At least for connection to the connecting members 15, the connecting member 21 has plugging receptacles 24, e.g. in the form of plugging bushes which, on leading the connecting piece 21 up to the connecting members 15, automatically receive the same in an electrically conductive connection.

In the connecting position, the connecting piece 21 passes through part of the window opening 19 and in particular that part located in the vicinity of jacket 18 and a part connected thereto in bottom 17 over the full width and optionally over the full height, so that said parts of the window opening 19 are directly closed in substantially tight manner by the connecting piece 21. Connecting piece 21, which is appropriately in engagement with the underside of hotplate 3 or cover plate 13, projects slightly over the undeside of the bottom 17 of cover pan 16. The area of the closure 20 formed by insulator 22 and closing the remainder of the window opening 19 is appropriately formed by a plate-like projection 25, which projects over the connecting side of the insulator 22 associated with the connecting members 15 in the direction of the central axis 10. This projection 25 can engage over the edge of the window opening 19 on both sides lateally on the top and/or bottom in a substantially spacing-free manner or with limited spacing and in the represented embodiment is at a limited distance below the bottom 17 of cover pan 16, so that its underside is in one plane with the underside of the remaining insulator 22.

Figure 3:
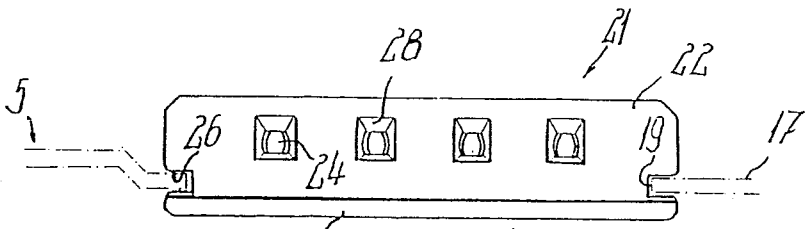
FIG. 3, the closure or connecting piece according to FIG. 1 in a view of the underside and on a larger scale.

In the vicinity of connecting piece 21, the closure 20 is laterally provided on both sides with grooves 26, in which engage the associated areas of the lateral marginal zones of the window opening 19 according to FIG. 3 located in the bottom 17, in the manner of a sliding guide. It is also possible to provide in the lateral faces of insulator 22 or closure 20 locking openings 27 or locking cams, which cooperate with complementary locking cams or locking openings of the cover pan 16 or holding part 5, said complementary locking members being provided in the vicinity of boundary edges of the part of the window opening 19 located in jacket 18 or can be formed by the same.

As is shown in FIG. 3, guiding and orienting faces 28 for the ends of the connecting members 15 are located at the insertion end of the connecting piece 21 for the connecting members 15 and in the vicinity of each plugging receptacle 24. These guiding and orienting faces 28, which can optionally also be formed by the metallic plugging receptacles 24 are appropriately directly formed by the insulator 22, so that they are made from insulating material and can e.g. be made in very smooth-surfaced form and therefore have a low friction through the use of a glaze. The guiding and orienting faces 28 which, in the mounting position, are connected at least at the top and/or bottom to the particular plugging receptacle 24 and which are inclined with respect to the plugging direction are appropriately closed over the entire circumference or taper in funnel-shaped manner around the central axis of the particular plugging receptacle 24 in the insertion direction of the connecting members 15.

Thus, prior to the connection to the connecting piece 21, the connecting members 15 can diverge within relatively wide tolerance limits from the insertion position and in spite of this on moving up the connecting member 21 they are independently of one another precisely oriented with the inserted position, because their ends slide on the guiding and orienting faces 28 and are automatically inserted in the plugging receptacles 24.

For the e.g. fully mechanized assembly of the cooker plate 1, initially the electric hotplates 3 are placed in the upside down position and in the predetermined geometrical arrangement on a surface and then the mounting plate 2 in the upside down position is mounted in such a way that all the hotplates 3 engage in the plate openings 4. Then, an e.g. plate-like intermediate part 29 common to all the hotplates 3 or provided separately for each of these is placed on the mounting plate 2, which prevents the rotation of hotplates 3 about the central axes 10 and engages in an appropriate manner in their undersides. The holding part 5 is finally placed on and is braced with the fastening bolt 11 against the hotplate 3 and the mounting plate 2. In place of the represented cap screw, the fastening bolt 11 can also be a staybolt, which has a nut locking the cover plate 13 against the central stud 9 and on whose side remote from the cover plate 13 engages the holding part 5 and is locked with another nut.

Before, after or simultaneously with the locking of holding part 5, the closure or closures 20 together with the connecting pieces 21 are brought into their closed position and simultaneously the connecting members 15 of the electric hotplates 3 are connected to the connecting lines 23. As is shown in FIG. 3, the bottom 17 of holding member 5 shown by dot-dash lines is offset at at least one side adjacent to the grooves 26 of insulator 22.

Figure 5:
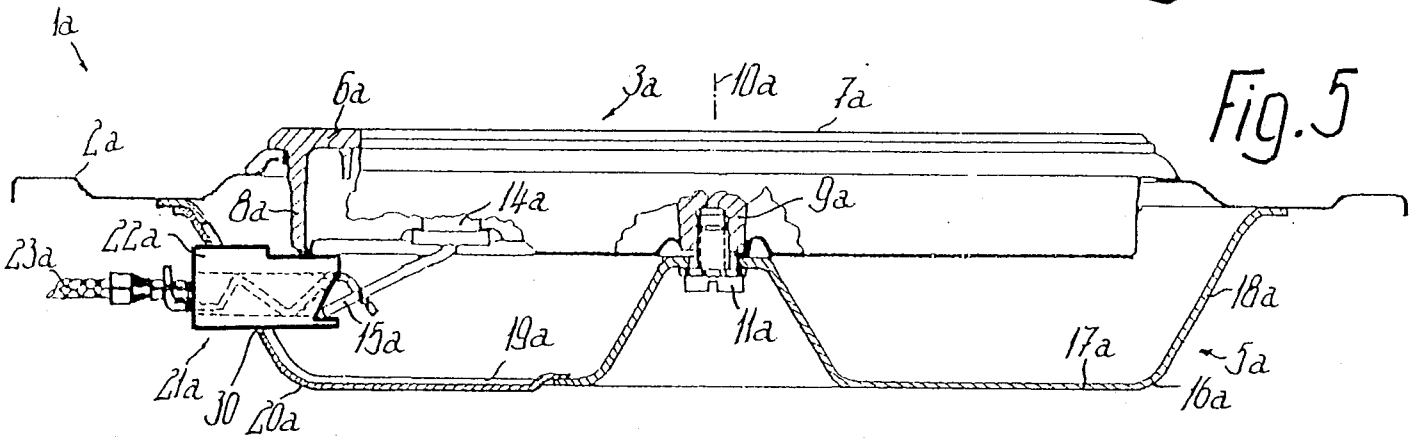
FIG. 5, another embodiment of a cooker plate in cross-section and in the use position.

In the embodiment according to FIG. 5 the closure **20*a* is formed by a component separate from the connecting piece 21*a* and which can e.g. be formed from the same sheet metal as the separate holding part 5*a* provided in this case for the hotplate 3*a*, or the cover pan 16*a*. In the axial section according to FIG. 5 the closure 20*a* from its radially outer to its radially inner end engages substantially uninterruptedly on the outer face of the cover pan 16*a*** and for this purpose it can be multiply angled or bent in accordance with its cross-section.

At least one end the resiliently deformable closure **20*a* has a tongue or a similar holding member for engaging behind the cover pan 16*a* and said tongue is then appropriately located on the inside of cover pan 16*a*. If, as shown, said tongue is located on the radially inner end of closure 20*a*, then it secures the closure 20*a* against downward movements. A tongue optionally provided on the radially outer end and which can be sprung in through the resilient compression of the legs of the angular closure 20*a* in cover pan 16*a*, secures the closure 20*a* against movements, which are directed radially outwards with respect to the central axis 10*a***.

In the part or leg of closure **20*a* covering the jacket 18*a* is provided a bushing or passage 30 in the form of an opening closely adapted to the outer contour of the insulator 22*a* and which traverses the connecting piece 20*a*. As a result of the said reciprocal engagement between closure 20*a* and the connecting piece 21*a*, it is possible to positionally secure closure 20*a* or connecting piece 21*a***.

The connecting piece **21*a* according to FIG. 5 is not intended for plug connection to the connecting members 15*a*, but instead its corresponding connecting parts are connected by spot welding to the connecting members 15*a*, so that this leads to a reliable positional stabilization of the connecting piece 21*a* and optionally closure 20*a***.

The ends of the connecting lines **23*a* formed e.g. by multicore cable ends can be connected to the associated connecting parts of connecting piece 21*a*** by means of detachable plug connections or spot welded joints.

In the embodiment according to FIG. 5 the connecting piece **21*a* can initially be connected to the connecting members 15*a* with the window opening 19*a* completely open, after which the closure 20*a* mounted on the connecting lines 23*a* and traversed by the same in passage 30 is moved along the connecting lines 23*a* and then onto insulator 22*a*** to such an extent that it is located in the closed position.

In FIGS. 5 to 13 the same parts are given the same reference numerals as in the remaining drawings, but are followed by different letter references and the description is correspondingly similar.

In the embodiment according to FIGS. 6 and 7, the closure **20*b* is once again formed by a plate-like projection 25*b* of the insulator 22*b* of connecting piece 21*b*. Said projection 25*b* passes via a shoulder surface located on the underside of holding part 5*b* into the remaining insulator 22*b*, whereby the projecting longitudinal edge of said shoulder face can be supported on the underside of the base wall 17*b* of holding part 5*b*, which in the present case is provided for a single electric hotplate 3*b*. Closure 20*b* extends approximately over the entire width of the window opening 19b located in the circumferential direction of the hotplate, but does not extend over the entire extension of the window opening 19b at right angles thereto or radially with respect to the hotplate, so that only the radially outer part of opening 19b is closed or shielded, while the radially inner part of the window opening 19b traversed by the connecting members 15b remains open as a ventilation opening. With respect to said part, insulating sleeve 14b is slightly radially inwardly displaced, but in such a way that it still partly covers this part of the window opening 19b in a view from below. On the lateral boundaries of the window opening 19b are provided facing, reciprocally projecting support flaps 31, which are preferably in one piece with the holding part 5b and on whose insides, facing the hotplate 3b, can be supported in an articulated manner the projection 25b. Closure 20b or connecting piece 21b can consequently be inserted more steeply than in the use position into the associated part of the window opening 19b and can then be pivoted to the described support on the underside of base walls 17b, so that through said support and by the support on support flaps 31 and the connection to the connecting members 15b** it is positionally secured.

For support purposes, adjacent to the window opening the insulator can also have lateral shoulders projecting laterally over the projection 25b and at least one lateral shoulder can be located approximately in the plane of the upper shoulder surface.

Radially within the window opening 19b are provided in several rings around the central axis 10b a plurality of ventilation openings 32 in such a way that the insulating sleeve 14b is roughly located between the open part of window opening 19b and said ventilation openings 32. Within an inner flange edge 34 of the hotplate body 6b projecting less far downwards than flange edge 8b or on the outer circumference of the central stud 9b is arranged a thermal cutout 33 or its casing, which has a switching contact influenced by a temperature sensor, such as a snap-action switch. The temperature sensor can be a bimetallic sensor located within the switch casing or a rod-like temperature sensor projecting over said casing and which is located on the underside of the heated field of the hotplate body 6b. The ventilation openings 32 prevent in simple manner a heat build-up which is disadvantageous for the operation of the thermal cutout 33. The plugging receptacles 24b are in the case of the represented embodiment flat plugging tongues, which project in juxtaposed manner over the insulator 22b and within the latter are connected to the connecting members 15b, e.g. by spot welded joints.

Figure 8:
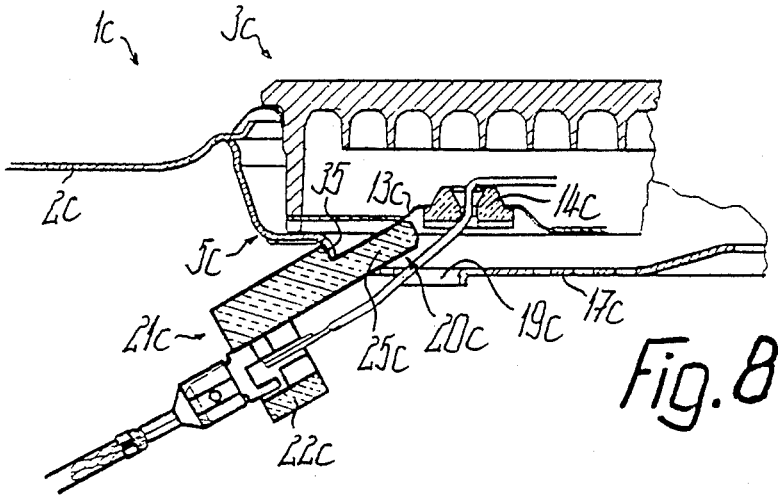
FIG. 8, another embodiment in a representation corresponding to FIG. 6.

In the case of the embodiment according to FIG. 6, in the assembly position, the connecting piece 21b drops away radially outwards under an angle of approximately 15° . However, the angle in the case of the embodiment according to FIG. 8 is approximately 30° and in this case the end of the projection 25c is supported immediately adjacent to the sleeve 14c on the underside of the cover plate 13c or is roughly connected to the insulating sleeve 14c. The shoulder of insulator 22c connected to projection 25c is in this case approximately located in the radially outer part of the window opening 19c. This part of the window opening 19c is bounded by a U-shaped collar shaped downwards out of the base wall 17c and which extends up to the support flaps.

In the embodiment according to FIGS. 9 and 10, in a view of the underside, insulating sleeve 14d is approximately congruent with the window opening 19d. The connecting piece 21d or its insulator 22d has a shaft part adapted to the window opening 19d and in the vicinity of the upper end a widened head 36, so that facing shoulders 35d or an all-round or annular shoulder is formed, which can be supported on the inside of the base wall 17d of holding part 5d. Head 36 or insulator 22d can in this case be fixed between the holding part 5d and the underside of the insulating sleeve 14d supported by a corresponding shoulder on the underside of the cover plate 13d or can be located with limited movement clearance between said two parts. The portion of the shaft part connected to head 36 forms the closure 20d approximately completely filling the window opening 19d. The passage openings in insulator 22d for the connecting members 15d or for the mounting of the plugging receptacles 24d can form shaft-like or chimney-like ventilation openings, which are connected to the passage opening of the insulating sleeve 16d. Angular or linear plugs can be connected in the manner shown in dot-dash form, can be connected to the downwardly directed plugging receptacle or which project over the underside of insulator 22d.

Figure 11:
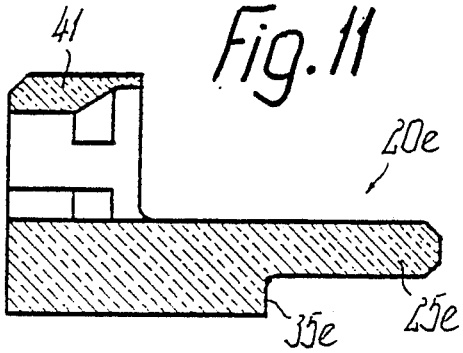
FIG. 11, the insulator of a further connecting piece in cross-section.
Figure 12:
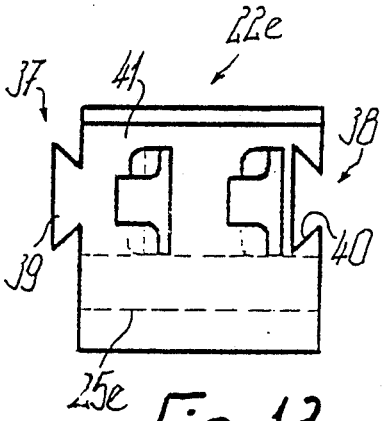
FIG. 12, the insulator according to FIG. 11 in a view from the left.
Figure 13:
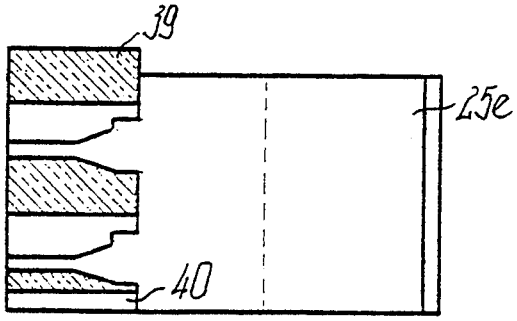
FIG. 13, a section through the insulator according to FIG. 11.

In the embodiment according to FIGS. 11 to 13 insulator 22e or the closure 20e is formed by at least one modular component, which is detachably connected to identical or similar components and can consequently be assembled to a connecting piece or closure of varying size. At the end remote from projection 25e, insulator 22e has a casing part 41 for receiving at least one electrical connection part, namely e.g. a plugging receptacle and in the represented embodiment the modular component is constructed in two-pin manner in the sense that it can carry two separate electrical connecting parts electrically insulated with respect to one another. Laterally on either side of said casing part 41 and therefore on either side of the plugging receptacles, (not shown further) is in each case provided a connecting organ 37 or 38. The two connecting organs 37,38 have a complementary construction, so that an identical modular component can be attached and the same can optionally be connected to a further, corresponding component. In the represented case, on one side is provided a dovetail plugging projection 39 with a plugging direction roughly parallel to that of the projection 25e or the plugging receptacle, while on the other side is provided a complementary, i.e. dovetail plugging recess 40 with the same plugging direction. The plugging projection 39 projects laterally over the associated lateral edge of projection 25e, so that interconnected, modular components can engage with one another in approximately whole-area manner with their lateral faces. In the case of a two-pin construction of the electric hotplate only one modular component is used, whereas in the case of a four-pin construction two such components are interconnected. The insulating parts are appropriately made from a ceramic hard material, such as steatite.

We claim:

1. A cooker plate, comprising:

a mounting plate having a top surface, an underside and at least one plate opening;

at least one electric hotplate to be received in one said at least one plate opening, said hotplate being a preassembled unit provided to engage against said top surface of said mounting plate and having an underside;

at least one holding means having an outside, an upper inside and being provided to be supported against the mounting plate and said hotplate for securing said hotplate with respect to said mounting plate;

electrical terminal connecting members of said hotplate, said connecting members being provided in a vicinity of the underside of the hotplate, said holding means having at least one window opening open in a connecting state for providing access to said connecting members, said window opening being provided for receiving external connection means to be connected to said connecting members, for electrical supply of power via power supply lines, wherein at least one closure means is provided for at least partially closing at least one of said window openings in a post-connecting state, said closure means providing at least one passage for the external connection means for said connecting members, said closure means at least partially shielding said terminal connecting members on said outside of said holding means.

2. The cooker plate according to claim 1, wherein said holding means is constructed in a cover-like manner for between one and a plurality of hotplates, said connecting members being located substantially on said inside of said holding means.

3. The cooker plate according to claim 1, wherein an external connecting piece is provided for connecting said power supply lines to said terminal connecting members of said hotplate, said connecting piece having an insulator body located in a vicinity of said closure means and said window openings.

4. The cooker plate according to claim 3, wherein at least in a closure position said closure means is provided on the external connecting piece, said closure means having an opening providing a passage for the insulator body of said connecting piece, the connecting piece being arranged to be led towards said connecting members upon connection to said power supply lines.

5. A cooker plate, comprising:

a mounting plate having a top surface, an underside and at least one plate opening;

at least one electric hotplate to be received in one of said at least one plate opening, said hotplate being provided to engage said mounting plate;

at least one holding means provided to be supported against at least one member including the mounting plate and said hotplate, said holding means at least partly covering an underside of said hotplate;

electrical terminal connecting members of said hotplate, said holding means having at least one window opening in a vicinity of said connecting members, said window opening being provided for electrical supply connection of said connecting members to power supply lines, wherein at least one closure means is provided for at least partially closing at least one of said window openings, said closure means providing at least one passage for said supply connection, a connecting piece being provided for connecting said power supply lines to said connecting members, said connecting piece having an insulator body located in a vicinity of said closure means, said insulator body of said connecting piece at least partially forming the closure means.

6. The cooker plate according to claim 1 or 5, wherein said hotplate is a temperature protected hotplate, said holding means comprising at least one ventilation opening at least partly formed by said window opening.

7. A cooker plate, comprising:

a mounting plate having a top surface, an underside and at least one plate opening;

at least one electric hotplate to be received in one of said at least one plate openings, said hotplate being provided to engage said mounting plate;

at least one holding means provided to be supported against at least one of members including the mounting plate and the hotplate;

electrical terminal connecting members on said hotplate, said holding means having at least one window opening in the vicinity of said connecting members, said window opening being provided for electrical supply connection of said connecting members to power supply lines, wherein at least one closure means is provided for at least partially closing at least one of said window openings, said closure means providing at least one passage for said supply connection, said closure means being arranged via a plug connection on said holding means.

8. The cooker plate according to claim 7, wherein the plug connection defines a plugging direction substantially parallel to a plugging-in direction for connecting said connecting members.

9. The cooker plate according to claim 1, 5 or 7, wherein at least one of said closure means substantially completely closes at least one of said window openings, thereby substantially shielding on an underside all of a number of electrically conducting bare parts associated with said connecting members.

10. The cooker plate according to claim 1, 5 or 7, wherein said window opening has a width extension and a radially outer portion, at least one closure means only shielding part of said window opening, said part extending over the entire width extension of the radially outer portion of said window opening, thereby providing an open part of said window opening, said connecting members being led through said open part of the window opening.

11. The cooker plate according to claim 1, 5 or 7, wherein said closure means is at least partly plate-like in shape.

12. The cooker plate according to claim 1, 5 or 7, wherein a member providing at least one of said connecting piece and said closure means is supported in downwardly directed manner on at least one of members provided by the holding means and an underside of said hotplate.

13. The cooker plate according to claim 1 or 7, wherein said connecting members project substantially parallel to a cooking surface of said hotplate.

14. A cooker plate, comprising:

a mounting plate having a top surface, an underside and at least one plate opening;

at least one electric hotplate to be received in one of said at least one plate openings, said hotplate being provided to engage said mounting plate;

at least one holding means provided to be supported against at least one of members including the mounting plate and the hotplate;

electrical terminal connecting members on said hotplate, said holding means having at least one window opening in the vicinity of said connecting members, said window opening being provided for electrical supply connection of said connecting members to power supply lines, wherein at least one closure means is provided for at least partially closing at least one of said window openings, said closure means providing at least one passage for said supply connection, at least one of members including the closure means and the holding means forming a tension relief for at least one of said power supply lines, said closure means being positively connected to said power supply lines and said holding means with respect to a tensioning direction.

15. The cooker plate according to claim 3, 5, 7 or 14, wherein said power supply lines are constructed for an electrically conducting plug connection with at least one of said connecting members, in a position closing said window opening, said closure means being secured by said plug connection to the connecting members.

16. A cooker plate, comprising:

a mounting plate having a top surface, an underside and at least one plate opening;

at least one electric hotplate to be received in one of said at least one plate openings, said hotplate being provided to engage said mounting plate;

at least one holding means provided to be supported against at least one of members including the mounting plate and the hotplate;

electrical terminal connecting members of said hotplate, said holding means having at least one window opening in the vicinity of said connecting members, said window opening being provided for electrical supply connection of said connecting members to power supply lines, wherein a connecting piece is provided for connecting said power supply lines to said connecting members, said connecting piece having an insulator body located in the vicinity of said window opening, an insulating sleeve for passage of said connecting members being provided on a lower cover plate of said hotplate, said connecting piece providing a substantially vertically downwardly direction extension of said insulating sleeve.

17. A cooker plate, comprising:

a mounting plate having a top surface, an underside and at least one plate opening;

at least one electric hotplate to be received in one of said at least one plate openings, said hotplate being provided to engage said mounting plate;

at least one holding means provided to be supported against at least one of members including the mounting plate and the hotplate;

electrical terminal connecting members on said hotplate, said holding means having at least one window opening in the vicinity of said connecting members, said window opening being provided for electrical supply connection of said connecting members to power supply lines, wherein at least one closure means is provided for at least partially closing at least one of said window openings, said closure means providing at least one passage for said supply connection, a connecting piece being provided for connecting said appliance lines to said connecting members, at least one of members provided by said closure means and said connecting piece having lateral grooves cooperating with marginal zones of said window opening.

18. The cooker plate according to claim 17, wherein said marginal zones of the window opening engage in the closure means in the manner of a sliding guide engaging an insulator body located in a vicinity of said closure means.

19. A cooker plate, comprising:

a mounting plate having a top surface, an underside and at least one plate opening;

at least one electric hotplate to be received in one of said at least one plate openings, said hotplate being provided to engage said mounting plate;

at least one holding means provided to be supported against at least one of members including the mounting plate and the hotplate;

electrical terminal connecting members on said hotplate, said holding means having at least one window opening in the vicinity of said connecting members, said window opening being provided for electrical supply connection of said connecting members to power supply lines, wherein a connecting piece is provided for connecting said power supply lines to said connecting members, said connecting piece having an insulator body located in a vicinity of said window opening, connecting parts being provided for connecting said insulator body in series to at least one complementary insulator body.

20. The cooker plate according to claim 19, wherein each said insulator body is constructed for receiving at most two connecting members.

21. The cooker plate according to claim 19, wherein at least one said connecting part is provided in one-part with the insulator body.

22. The cooker plate according to claim 19, wherein said connecting parts are dove tail shaped plugging parts.

* * * * *